US007549879B1

(12) United States Patent
Walsh

(10) Patent No.: US 7,549,879 B1
(45) Date of Patent: Jun. 23, 2009

(54) MODULAR SNAP-TOGETHER ELECTRICAL AND AIR CONNECTOR

(75) Inventor: James D Walsh, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/272,876

(22) Filed: Nov. 18, 2008

(51) Int. Cl.
*G03G 21/18* (2006.01)

(52) U.S. Cl. ..... 439/191; 439/192; 399/115; 250/324

(58) Field of Classification Search ..... 439/191, 439/192, 701, 928; 399/115, 168–173; 250/324–326
See application file for complete search history.

(56) References Cited

U.S. PATENT DOCUMENTS

| | | | | |
|---|---|---|---|---|
| 4,056,723 | A * | 11/1977 | Springett et al. | 250/324 |
| 7,295,793 | B2 * | 11/2007 | Palmer et al. | 399/115 |
| 7,375,944 | B2 * | 5/2008 | Izaki et al. | 361/230 |
| 2005/0116167 | A1 * | 6/2005 | Izaki et al. | 250/324 |

* cited by examiner

*Primary Examiner*—Gary F. Paumen
(74) *Attorney, Agent, or Firm*—James J. Ralabate

(57) ABSTRACT

This is a modular connector used to supply electricity and air to a corona assembly. The connector has an electrical component removably positioned on an air component. When one of these components becomes inoperative, it can be detached from the other component, and the detached component replaced with new functional component. The air component is configured to remove effluents such as ozone and $NO_x$ from the corona assembly.

19 Claims, 4 Drawing Sheets

MODULAR SNAP-TOGETHER ELECTRICAL AND AIR CONNECTOR

This invention relates to an assembly useful in electrostatic marking systems.

BACKGROUND

This invention will be described by way of example as it relates to a charging station of an electrostatic marking system. However, it is to be understood that this invention can be used in any station of an electrostatic marking system in addition to the charging station, such as transfer or pre-transfer station, pre-clean station or any other station where a corona charge is used.

Also, the present invention can equally be used in non-marking electrical systems that generate ozone or other noxious gasses such as AC high voltage systems. In addition, anywhere a high voltage charging device is used, the present invention is applicable.

Therefore, for clarity and by way of example, the modular connector of this invention will be described throughout as it relates to xerography.

By way of background, when using an electrostatic or xerographic marking system, a uniform electrostatic charge is placed upon a reusable photoconductive surface. The charged photoconductive surface is then exposed to a light image of an original to selectively dissipate the charge to form a latent electrostatic image of the original on the photoreceptor. The latent image is developed by depositing finely divided marking and charged particles (toner) upon the photoreceptor surface. The charged toner is electrostatically attached to the latent electrostatic image areas to create a visible replica of the original. The toned developed image is then transferred from the photoconductor surface to a final image support material, such as paper, and the toner image is fixed thereto by heat and pressure to form a permanent copy corresponding to the original.

In a typical electrostatic system, a photoreceptor surface is generally arranged to move in an endless path through the various processing stations of the Xerographic process. The photoconductive or photoreceptor surface is generally reusable whereby the toner image is transferred to the final support material, and the surface of the photoreceptor is prepared to be used once again for another reproduction of an original. In this endless path, several stations of corona charging are traversed. In known electrostatic copy processes, as those above noted, a number of electrostatic charging devices are used at various stations around the photoreceptor drum or belt. For example, the present invention can be used at any of the following stations: charge, recharge, pre-transfer, transfer, detack and preclean. These charging stations may involve a single corona device or multiple corona devices. Multiple corona device systems can be of a single type or a combination of different types of corona generating devices.

Many varied charging means are used for applying an electrostatic charge to the photosensitive member such as corona generating pins (pin corotron), corona generating wires (corotron) or corona generating glass coated wire (discorotron), for some examples. These all will be referred to as "corona charger" or "a corona charger" in this disclosure and claims. These devices can also be covered with a grid to further assist in generating a more uniform charge known as dicorotron, pin scorotron, scorotron or discorotron, respectively. These corona charging devices can be used as a single device or in a multiple device configuration utilizing any combination of the charging devices above mentioned. In high quality xerographic reproduction systems, a uniform charge is the foundation for production of a high quality output print.

A by-product of all corona charging devices are several gasses (most notably $NO_x$ and ozone) which are referred to in this discussion as "effluents". Effluents must be managed in today's machines for many reasons which will be discussed in this disclosure. This management is usually through some type of air extraction and/or filtering system. The effluents can interact with the surrounding atmosphere, which may include organic compounds like morpholine, and with the photoreceptor itself to produce substantial negative charging effects on the photoreceptor and adversely affect the resulting copy. These are sometimes called lateral charge migration (LCM) and/or parking deletion. This can cause the output of a printed copy to appear blurry or have areas where the image is entirely missing or deleted.

Nitric oxide deletions, ozone and other effluents have been a pervasive and persistent problem in these electrostatic copying systems. The various embodiments of this invention are simple and effective ways to minimize or eliminate these problems.

As noted above, there are presently three forms of charging devices: corotrons, scorotrons and discorotrons. All will be referred to in this disclosure as a source of "corona" discharge. These charging devices use high voltages to create a corona. This corona can be thought of as a collection of ions (charged atoms or molecules) in a local area. In most cases, the corona is influenced to move towards the desired target by the opposite charge on a screen or grid-type device.

As earlier discussed, the different charge devices or corotrons denote different configurations. Corotrons are simply bare wires. A high DC potential is placed on the corotron to create the corona. To charge photoreceptors to a positive voltage, a large positive DC voltage is placed on the corotron wire. To charge negatively, a negative potential is placed on the wire. Discorotrons are a wire device also. In this case, the wire is coated with a thin film of dielectric glass. Discorotrons have an alternating voltage placed on them to create both positive and negative ions. A screen or grid with a DC bias directs the discorotron's charge toward the photoreceptor. The grid voltage determines the polarity and amplitude of the charge placed on the photoreceptor.

An important consideration is that there are many ways to charge photoreceptors. Some ways have a propensity for problems to occur while others have less of an issue. In relation to ozone and nitric oxide deletions, the AC devices (discorotrons) and the negative DC devices have a higher probability of deletion problems.

The charge device or corona is the originator of the ozone and nitric oxide parking deletions. The deletion process begins with the production of corona in normal atmosphere. Corona is a "cloud" of charged ions. Different types of corona contain different ions, $H^+$ and $N_4^+$ are the major positive ions for both AC and DC devices. The negative ions $NO_3^-$ and $O_3^-$ (ozone) are the major ions in negative DC discharge and AC with airflow. AC devices (discorotrons) also produce the following negative ions: $O^-$, $OH^-$, $O_2^-$, $NO_2^-$, $CO_3^-$.

The ozone ($O_3$) and $NO_x$ (NO and $NO_2$) occur in relatively large amounts. These compounds are also very chemically reactive. $NO_x$ is known as Oxides of Nitrogen. While both gasses and morpholine can contribute to the deletion problem, $NO_x$ has been cited as the main culprit, hence the reference in literature and studies to "Nitric Oxide Deletion".

Recent experiments show that the $NO_x$ output from a discorotron operated at nominal voltage is entirely $NO_2$. Charge device $NO_2$ output is attributed to the presence of ozone in the charge device area. Ozone oxidizes NO to $NO_2$.

The oxidation of NO to $NO_2$ produces one photon of light at about 1200 nm. This occurs in about 20% of the oxidized $NO_2$. As the molecule decays to a stable state, a photon is emitted with the peak excitation of 1200 nm. This is the basis for a Chemilluenesence Nitric Oxide detector sometimes used in the prior art to measure effluents.

Photoreceptors have been shown to be very sensitive to nitric acid-type compounds ($HNO_3$ and $HNO_2$). The nitric acid attacks certain molecules in the transport layer of the photoreceptor rendering them too conductive. This conductivity allows any developed charge on the photoreceptor to leak to ground in the area of the attack or spread in what is sometimes (mistakenly) called lateral charge migration. Lateral charge migration is a separate issue involving the deposit of conductive salts on the photoreceptor through the interaction of corona and atmospheric contaminants, such as morpholine. In Nitric Oxide deletions, in the worst cases, areas near the acid attack appear blank on a copy because toner is not developed to the photoreceptor in those areas. In lesser extent cases, the problem manifests itself as a blurring of the image. Some volatile organic compounds, such as morpholine and organic nitrates are effluents also detrimental to the photoreceptor.

The modular electrical and air connector embodiments of the present invention provide strategies employed to combat and minimize these deletions.

Previous to this invention, the electrical and air connectors were one-piece integral connectors. Failures to any part the electrical system required replacement of the entire connector. The connector although built from many similar pieces all pieces of the main body were permanently fixed to each other. Replacement of the complete device was necessary for any failures in either the air portion or the electrical portion. This prior art integral connector is relatively expensive and complex as compared to the modular connector of the present invention.

SUMMARY

To reduce these deletions and noxious by-products, several means have been used including protective shields and the above noted one-piece integral connector. The prior art connector and the connector of the present invention impose an air flow into the environment around the corona charging devices for effluent or impurities extraction. Since these impurities cause serious negative charging effects, they need to be exhausted from the system. Uniform charging in each xerographic station, including the charging station, is necessary for the proper operation of the electrostatic marking system. With effluents affecting the photoconductor, this uniform charging is sometimes not possible. The prior art integral connector previously used to remove effluents was expensive, required frequent entire replacement, and not totally reliable.

The present invention is a modular electrical and air connector in which the electrical and air components are not permanently fixed to each other. With this design, a failure in the electrical portion or component only requires the replacement of the electrical portion. Replacement of other parts within this assembly only requires snapping off the old piece and snapping on a new piece. This includes all grounding connections and latches. This invention utilizes a simple design for manufacturing concepts to achieve improved reliability and reduce costs. By using each component to provide multiple functions, the number of parts required for the assembly has been reduced from prior art connectors 50 to 27 for present modular connector. By having the electrical subassembly or component snap onto the air duct several advantages are observed. First, the electrical component can now be replaced independently when an electrical failure occurs such as in the resistors. Second, the component has fewer parts and is simpler to use. The component requires only one potting operation. In the present connector only one resistor is required per output connection, increasing the reliability. High voltage testing of the components is simplified because of the reduced size of the electrical component. The electrical component with three output ports can be easily adapted to any number of output ports from one to many.

In the present modular connector, the air duct has also been simplified. The number of parts required for air flow has been reduced. The hose connection has been molded into the rear of the air duct body. This eliminates the seal and separate connector previously used in prior art connectors. All internal vanes have been removed and the balancing of the air flow is a function of the front gasket and gasket plate. In fact, three different gaskets have been designed to improve air flow balance for three independent and different machine configurations. The air body or component of the present connector also has a snap-in latch feature, making replacement of damaged latches easy and less costly.

The present modular connector offers the following advantages over the one-piece prior art connector:

- Simple design—reduced parts from 50 to 27;
- Field implementable—this new design will work on the same mounting as the prior art connector, and can be easily retrofitted in existing machines;
- Manufacturing cost reduction—cost reduction is approximately one third the cost of the prior art connectors.
- Service cost reduction—The most costly part of the connector is the electrical component; replacement of this component only will be approximately one third the cost for the replacement of the entire current prior art connector;
- Improved component reliability—The reliability in the connector of the present invention is improved due to reduced number of electrical parts and electrical connections;
- Replaceable latch features in the connector of the present invention will reduce service cost and time by allowing simple latch replacement in case of failure.

The connector of the present invention can be used in any xerographic system having at least one imaging station to several imaging stations such as in a xerographic color system where an array or series of different color imaging stations or modules are aligned above an endless belt. Each station in this color system contains an upper positioned raster output scanner (ROS) and below the ROS is an imaging station or module comprising the photoreceptor drum and the conventional xerographic stations i.e. charge station, exposure station, development station, transfer station, cleaning station, etc., each having at least one assembly comprising a corona charger. Thus, the connector of this invention can be used in any monochromatic system or color stations of a color marking system.

An additional important advantage of the present modular connector is that it can be easily retrofitted into the existing monochromatic or color marking systems without any major adjustments.

Thus, the present invention provides an easily retrofitted modular electrical and air connector in which the electrical and air system components are not permanently fixed to each other as in the prior art. The electrical part or component can be easily disconnected from the air system component or part. With this design as above noted, a failure in the electrical component or portion requires only the replacement of the electrical component, and likewise with the air system component. Replacement of parts in the assembly can be done by snapping off the old piece and snapping on a new piece. This includes all grounding connections and latches.

DETAILED DESCRIPTION OF THE DRAWING AND PREFERRED EMBODIMENT

Figure 1:
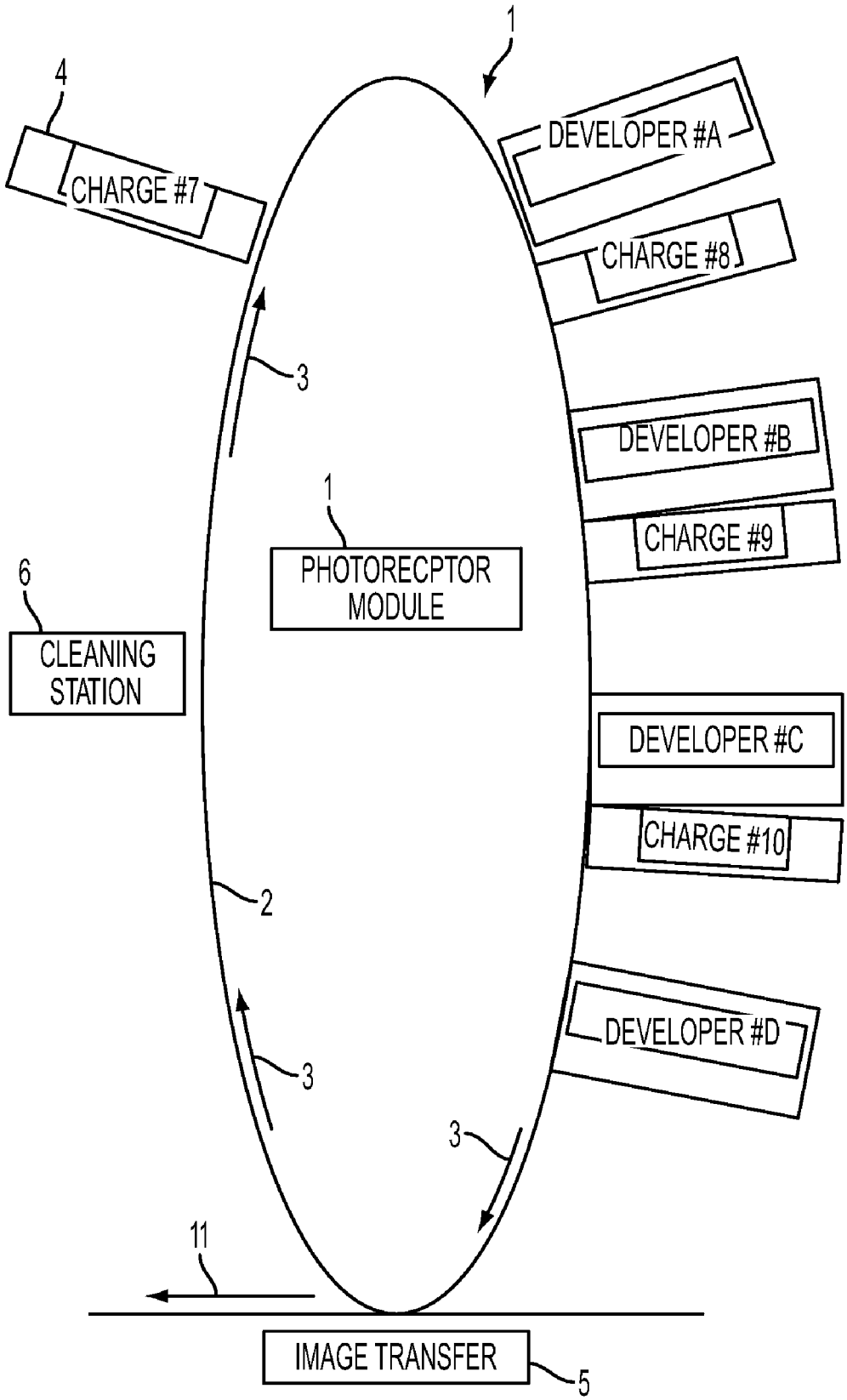
FIG. 1 illustrates a color electrophotographic marking module or system having four separate developer stations A, B, C and D.

The photoreceptor module 1 comprises a photoconductor or intermediate belt 2 that travels through each of the development stations or assemblies A, B, C and D. The arrows 3 indicate the travel direction of belt 2. Each station A-D contains a different color developer that is used to develop a latent xerographic image on belt 2. Each station along the path of belt 2 that has a corona charging unit, i.e. charging station 4, transfer station 5, cleaning station 6 (or other stations) could include a modular snap together electrical and air connector of this invention. The system 1 of FIG. 1 is illustrated by way of example and not limitation. As earlier stated, any station that uses an assembly with a corona will have an electrical and air connector of this invention. For example, in addition to stations 4, charge 7, charge 8, charge 9 and charge 10 stations 5 and 6 could utilize a modular electrical and air connector of this invention connector and would be of that station or assembly.

Figure 2:
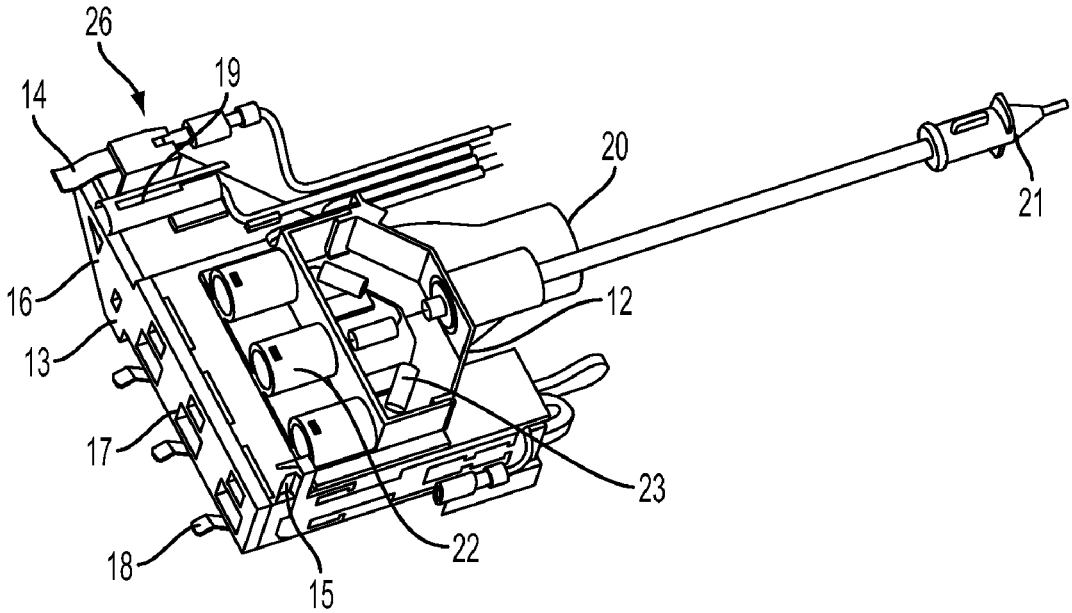
FIG. 2 illustrates in a top perspective an embodiment of the connector of this invention as it is fully assembled.
Figure 3:
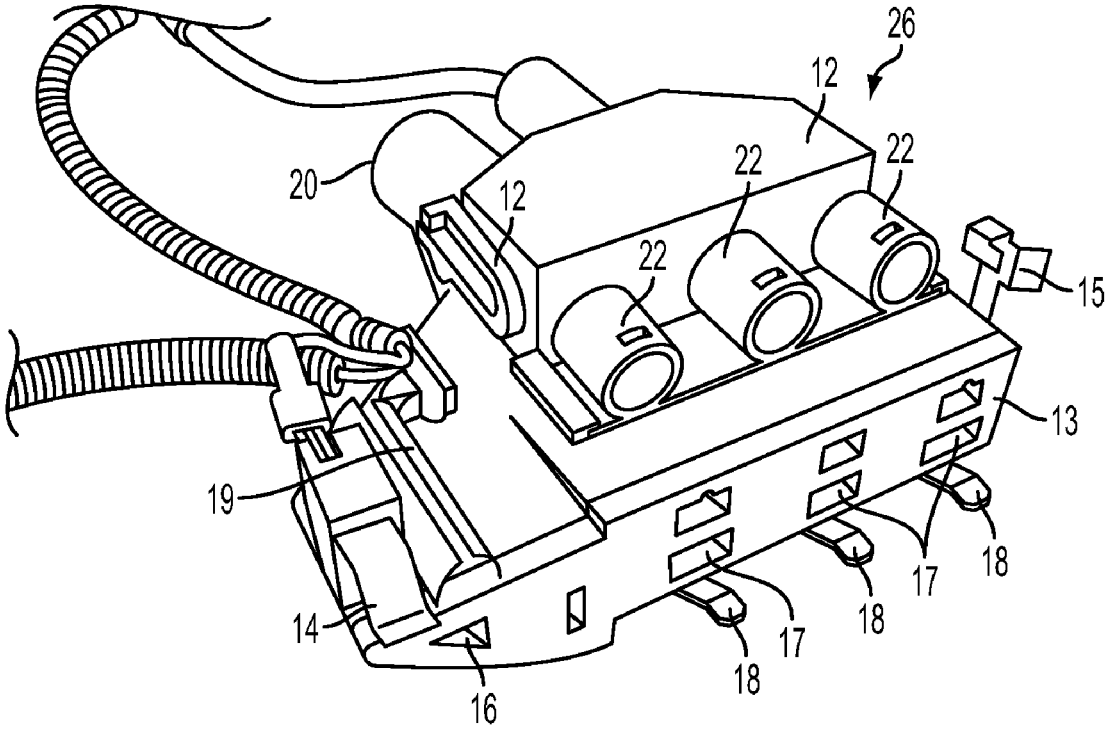
FIG. 3 illustrates in a top perspective an embodiment of the modular connector of this invention before separation of the air component from the electrical component.

FIGS. 2 and 3 illustrate an embodiment of the modular electrical and air connector of this invention. The electrical component 12 and air components 13 are not permanently fixed to each other but are detachable or separable. The connector has a DC grid contact 14 and an AC grid contact 15. On an end portion of air component 13 is the DC scorotron connections: the DC Grid Connection 14, DC High Voltage Connection 19 and air exit 16; adjacent to 16 is an AC corotron air supply 17 and at an end section of air component 13 is an AC corotron ground contact 18.

On the removable or separable electrical component 12, an AC high voltage connection to power supply 21, AC high voltage connection to corotron 22, and resistors 23. By high voltage it is meant voltages in excess of 1K volts AC or DC. Electrical component 12 is removable from air component 13, so in the event of a resistors failure, only the electrical component 12 needs to be replaced, rather than the entire integral unit 12-13 as in the prior art. This represents a significant savings from prior art systems. At 20 is shown an air supply inlet 20 for feeding air to air exists 16 and 17 and to the assembly containing a corona charging means or corona charger.

Figure 4:
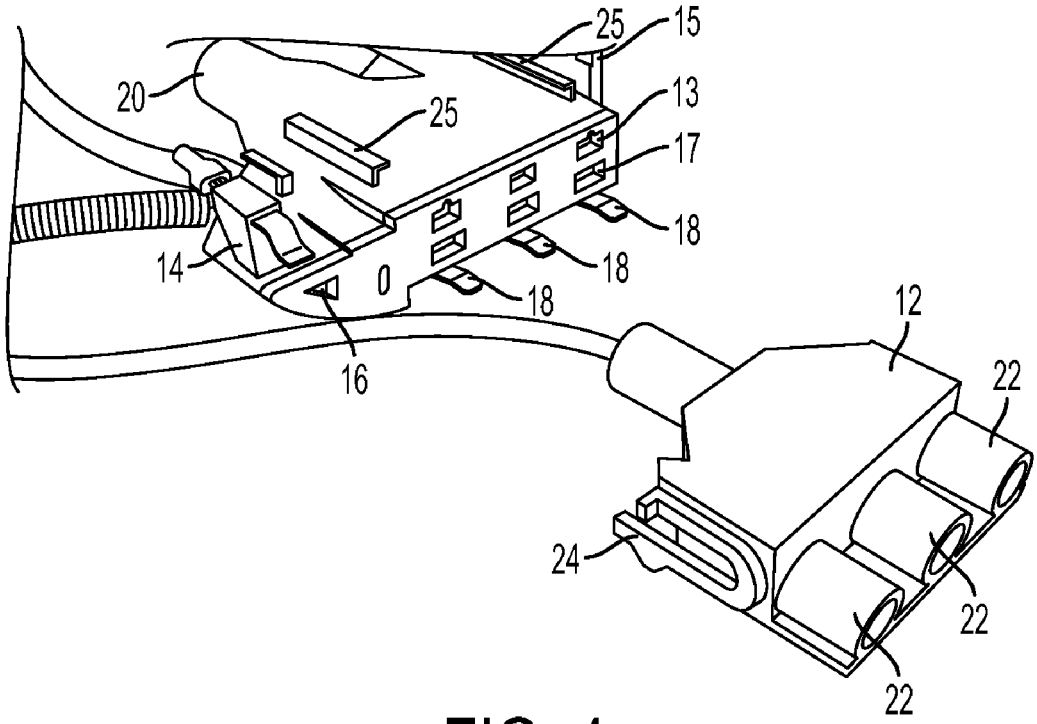
FIG. 4 illustrates the modular connector of this invention when the air section or component is separated from the electrical portion or component.

FIG. 4 shows the connector of this invention when electrical component 12 is separated from air component 13. A male slide clip 24 is positioned on electrical component 12 that is removably positioned in a mating receiving clip 25 in air component 13. These clips 24 and 25 can be preferably on both sides of components 12 and 13. The modular connector 26 of this invention is smaller and more reliable than prior art integral unit connectors, can be easily retrofitted into existing marking systems, is a simple detachable design, and much less expensive than prior art unit integral connectors. Most importantly, as indicated above, only one of the components 12 or 13 needs to be replaced if the other goes bad, or is broken, or becomes non-functional.

In summary, this invention provides an electrical and air modular connector for use in an electrophotographic marking system. This connector comprises an electrical component, and an air component. The electrical component is removably positioned on and above the air component. The air component is configured to convey air into an assembly comprising a corona charger and thereby discharge effluents from the assembly. The electrical component is configured to provide AC and DC high voltage connections for the corona charger.

The air component comprises at least one air supply inlet and at least one air supply outlet to said corona assembly. The electrical component and air component are detachable from each other. The electrical component comprises electrical resistors. These resistors are separable from the air component when the resistors become non-functional and inoperative. The air component comprises at least one DC scorotron air outlet and at least one AC corotron air outlet to the assembly containing the corona. The electrical component comprises at least one AC high voltage connection to a power supply, and the electrical component is slidably removable from the air component. The electrical component preferably comprises one DC high voltage connection and three AC high voltage connections.

Also provided herein is an electrophotographic marking system comprises at least one corona charger assembly and station. Each assembly comprising a corona charger and modular connector comprising an air component and an electrical component. The electrical component is removably positioned on and over the air component. The air component is configured to convey air into the assembly and thereby discharge effluents therefrom. The electrical component is configured to provide AC and DC high voltage connections for the corona charger in the assembly. The assembly and station is selected from the group consisting of charge stations, recharge stations, pre-transfer stations, transfer stations, detack stations and pre-clean stations. The air component comprises at least one air supply inlet with at least one air supply outlet to the corona assembly. The electrical component and the air component of the connector are detachable from each other. The electrical component preferably comprises one DC high voltage connection and three AC high voltage connections. The connector is positioned in the charge stations adjacent to the corona. The connector positioned in the charge stations and at least one other station in the marking system. The connector is configured to remove ozone, $NO_1$ and $NO_2$ from the assembly that is emitted from the corona.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrical and air modular connector for use in an electrophotographic marking system, said connector comprising:

an electrical component, an air component, said electrical component removably positioned on and above said air component, said air component configured to convey air into an assembly comprising a corona charger and thereby discharge effluents therefrom, said electrical component configured to provide AC and DC high voltage connections for said corona charger.

2. The connector of claim 1 wherein said air component comprises at least one air supply inlet, at least one air supply outlet to said corona assembly, and removable DC electrical connections.

3. The connector of claim 1 wherein said electrical component and said air component are detachable from each other.

4. The connector of claim 1 wherein said electrical component comprises electrical resistors, said resistors separable from said air component when said resistors become non-functional.

5. The connector of claim 1 wherein said air component comprises at least one DC scorotron air outlet and at least one AC corotron air outlet to said assembly.

6. The connector of claim 1 wherein said electrical component comprises at least one AC high voltage connection to a power supply.

7. The connector of claim 1 wherein said electrical component is slidably removable from said air component.

8. The connector of claim 1 wherein said electrical component comprises one DC high voltage connection and three AC high voltage connections.

9. An electrophotographic marking system comprising at least one corona charger assembly and station, each said assembly comprising a corona charger and a modular connector comprising an air component and an electrical component, said electrical component removably positioned on and over said air component, said air component configured to convey air into said assembly and thereby discharge effluents therefrom, said electrical component configured to provide AC and DC high voltage connections for said corona charger, said assembly and station selected from the group consisting of charge stations, recharge stations, pre-transfer stations, transfer stations, detack stations and pre-clean stations.

10. The connector of claim 9 wherein said air component comprises at least one air supply inlet at least one air supply outlet to said corona assembly and detachable DC electrical connections.

11. The connector of claim 9 wherein said electrical component and said air component are detachable from each other.

12. The connector of claim 9 wherein said electrical component comprises electrical resistors, said resistors separable from said air component when said resistors become non-functional.

13. The connector of claim 9 wherein said air component comprises at least one DC scorotron air outlet and at least one AC corotron air outlet to said assembly.

14. The connector of claim 9 wherein said electrical component comprises at least one AC high voltage connection to a power supply.

15. The connector of claim 9 wherein said electrical component is slidably removable from said air component.

16. The connector of claim 9 wherein said electrical component comprises one DC high voltage connection and three AC high voltage connections.

17. The marking system of claim 9 wherein said connector is positioned in said charge stations adjacent to the corona.

18. The marking system of claim 9 wherein said connector is positioned in said charge stations and at least one other said stations in the marking system.

19. The marking system of claim 9 wherein said connector is configured to remove ozone, $NO_1$ and $NO_2$ from said assembly that is emitted from the corona.

* * * * *